United States Patent [19]

Hanssen et al.

[11] Patent Number: 4,617,432

[45] Date of Patent: Oct. 14, 1986

[54] ADJUSTABLE PRESSURE RESPONSIVE SWITCH ASSEMBLY

[75] Inventors: Tore B. Hanssen; Abed G. Kahale, both of Hoffman Estates, Ill.

[73] Assignee: Controls Company of America, Schiller Park, Ill.

[21] Appl. No.: 730,010

[22] Filed: May 3, 1985

[51] Int. Cl.[4] ..... H01H 35/34

[52] U.S. Cl. ..... 200/81 R; 403/407.1; 74/107; 137/387; 200/83 WM; 200/153 LA; 200/83 SA

[58] Field of Search ..... 200/61.2, 84 B, 81 R, 200/153 SC, 153 L, 153 LA, 286, 290, 329, 83 P, 83 R, 83 WM, 83 S, 83 SA; 74/107; 337/318, 319; 137/387, 392; 73/717, 723; 403/254, 406.1, 407.1

[56] References Cited

U.S. PATENT DOCUMENTS

| | | | |
|---|---|---|---|
| 1,432,349 | 10/1922 | McFarland | 403/407.1 |
| 3,579,284 | 5/1971 | Mason et al. . | |
| 4,262,178 | 4/1981 | Berlin, Jr. | 200/83 WM |
| 4,263,489 | 4/1981 | Bergeson . | |
| 4,295,019 | 10/1981 | Buckshaw . | |
| 4,470,716 | 9/1984 | Welch | 403/407.1 |

*Primary Examiner*—G. P. Tolin

*Attorney, Agent, or Firm*—David L. Davis; Robert E. Smith; Edward L. Bell

[57] ABSTRACT

An adjustable pressure responsive switch assembly includes a unitary slide cam and button with projections extending outwardly from the slide cam. The support bracket mounted on the pressure switch includes an elongated slot having an enlarged opening at one end. The slide cam projections are adapted to be inserted in the enlarged opening and then be slidingly received in the elongated slot. The slide cam cannot be removed from the bracket unless it is moved all the way to one extreme so that the projections can be removed from the enlarged opening. This movement is prevented by stops formed as part of the cam.

3 Claims, 5 Drawing Figures

Fig. 1.
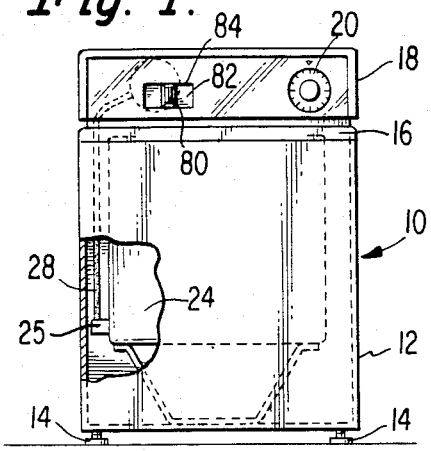
Fig. 2.
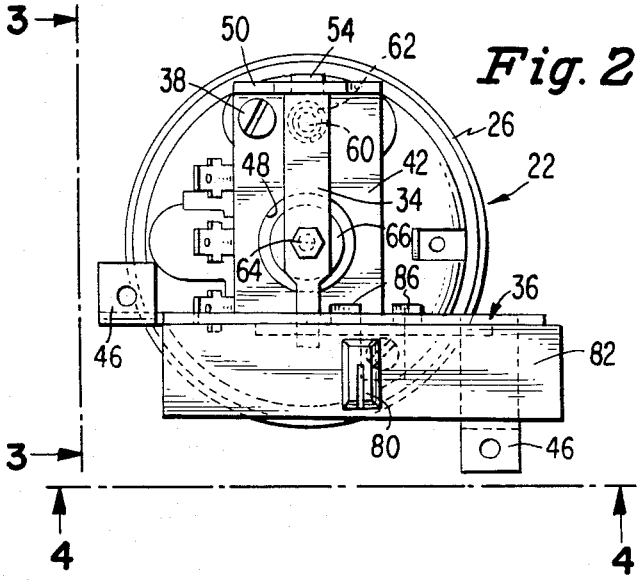
Fig. 3.
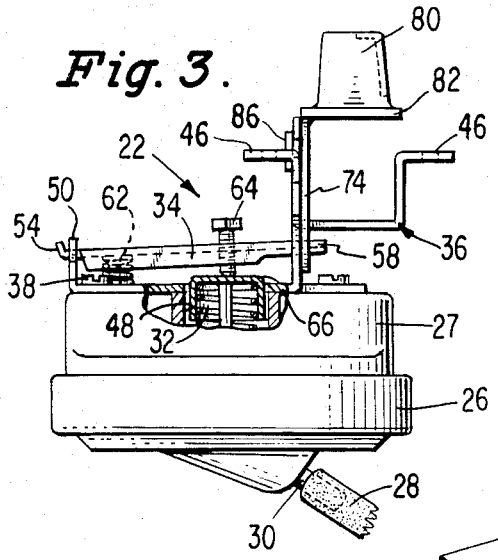
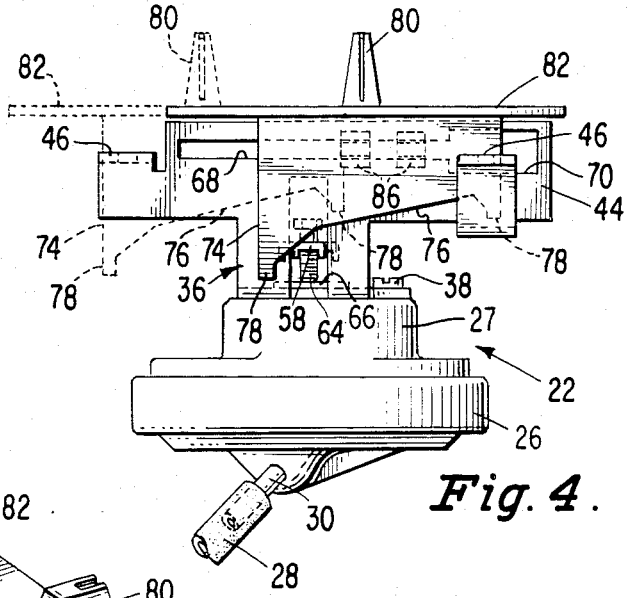
Fig. 4.
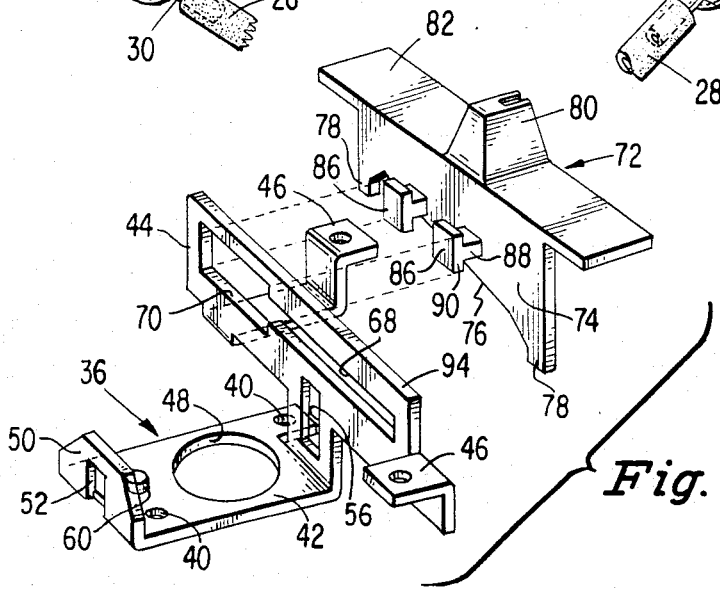
Fig. 5.

ADJUSTABLE PRESSURE RESPONSIVE SWITCH ASSEMBLY

BACKGROUND OF THE INVENTION

This invention relates to pressure responsive switches and, more particularly, to an adjustment mechanism for such a switch.

Pressure responsive switches used for fluid level detection in appliances are conventionally constructed with an adjustment mechanism whereby the desired fluid level may be varied. Common forms of adjustment mechanisms include a rotary cam actuator, a pushbutton control, and a slider bar cam actuator. It is an object of the present invention to provide, for a pressure responsive switch, an adjustment mechanism of the slider bar cam actuator type.

While there have been attempts to provide a slider bar cam actuator for a pressure responsive switch, such attempts have not proven to be entirely satisfactory, for a variety of reasons. Thus, with some prior designs, assembly has proven to be difficult. With other designs, the manufacturing costs have been too high. It is therefore another object of the present invention to provide a low cost sliding mechanism for a pressure responsive switch assembly, which mechanism is relatively inexpensive and easy to assemble.

SUMMARY OF THE INVENTION

The foregoing and additional objects are attained in accordance with the principles of this invention by providing an adjustable pressure responsive switch assembly comprising a pressure actuated switch mechanism, an adjustable element in the switch mechanism for effectively varying the relative pressure at which the switch mechanism will actuate, bracket structure supporting the switch mechanism, the bracket structure including a planar piece having an elongated open slot therein, a unitary slider member including cam means for engaging with and effecting movement of said adjustable element to vary the adjustment of the switch mechanism as the slider member is moved, and means for mounting the unitary slider member on the bracket structure including means projecting through the slot and attached to the slider member, the projecting means being formed as a unitary part of the slider member and including a stem portion and an enlarged head portion, the slot having an enlarged region through which the head portion may be inserted, the enlarged region being outside the normal range of travel of the projecting means along the slot.

BRIEF DESCRIPTION OF THE DRAWINGS

The foregoing will be more readily apparent upon reading the following description in conjunction with the drawings in which like elements in different figures thereof have the same reference character applied thereto and wherein:

FIG. 1 is a general front view of an automatic washing machine showing the control panel surface and partially broken away to show the washing machine tub;

FIG. 2 is an elevation view of an adjustable pressure responsive switch assembly constructed in accordance with the principles of this invention;

FIG. 3 is a view taken along the line 3—3 in FIG. 2;

FIG. 4 is a view taken along the line 4—4 in FIG. 2; and

FIG. 5 is an exploded perspective view showing the bracket structure and unitary slider member constructed according to this invention.

DETAILED DESCRIPTION

Referring now to the drawings, FIG. 1 shows an automatic washing machine, designated generally by the reference numeral 10. The washing machine 10 includes a wraparound cabinet 12 which surrounds a base frame (not shown) supported on a plurality of adjustable legs 14. The cabinet 12 further includes a top cover 16 having a hinged access door (not shown) normally covering a loading and unloading opening. The top cover 16 mounts an upwardly extending housing 18 for accommodating the various control members such as programming means actuatable by a dial 20. Also included among the various control members could be switches for providing temperature selections, wash/-spin speeds, soak option and water level selection. In particular, water level selection is effected through an arrangement constructed in accordance with this invention and fully described hereinafter.

In an automatic washing machine, a pressure responsive switch assembly 22 is typically used for controlling the fluid fill valve to obtain various selected fluid levels in the tub 24. The pressure switch air chamber 26 may be connected to the tub 24 by means of a pressure tube 28 connected near the bottom of the tub 24 through air trap 25 and to the switch air chamber 26 at the inlet 30. The switch air chamber 26 is responsive to head pressure, such as those produced by the height of the fluid in the washing machine tub 24. This head pressure compresses the air trapped in the air trap 25, the pressure tube 28 and the switch air chamber 26. The trapped air applies pressure to a diaphragm within the switch air chamber 26 which is operable for opening a switch contact when a predetermined fluid level has been reached in the washing machine tub 24. As is shown in FIG. 3, a biasing spring 32 communicates between an adjustable lever 34 and the switch toggle mechanism through the diaphragm located within the switch air chamber 26. As the adjustable lever 34 is moved, the amount of biasing force exerted by the spring 32 on the diaphragm is varied. Changing the biasing force on the toggle mechanism controls the operating point of the pressure switch. The foregoing operation is conventional in the art.

The switch mechanism housing 27 is secured to bracket structure 36 by means of screws 38 which extend through suitable openings 40 in the base portion 42 of the bracket structure 36. The bracket structure 36 is unitarily formed with a planar piece 44 extending upwardly from the base portion 42. The planar piece 44 has outwardly extending tabs 46 which are utilized to secure the switch assembly 22 to the housing 18 of the washing machine 10. The base portion 42 is formed with an enlarged opening 48 through which the lever 34 communicates with the spring 32. The bracket structure 36 is also formed with an upstanding wall 50 extending from the base portion 42. The upstanding wall 50 has an opening 52 through which the tail 54 of the lever 34 extends. The planar piece 44 is formed with an elongated opening 56 through which the operating end 58 of the lever 34 extends. The base portion 42 also includes an upwardly extending stub 60 for holding a spring 62 which bears upwardly against the lever 34 to maintain the tail 54 at the upper end of the opening 52 so that the lever 34 pivots about this point of contact. An adjustment screw 64 extends through the lever 34 to contact the cup 66 surrounding the upper end of the spring 32.

According to this invention, the planar piece 44 is formed with an elongated open slot 68. At one end, the slot 68 is formed with an enlarged region 70. A unitary slider member 72 is mounted on the bracket structure 36. The slot 68 provides for this mounting and also acts as a guide for sliding movement of the member 72, and will be described in full detail hereinafter.

The slider member 72 is a unitary structure that includes a cam, an operator engagement button, and mounting means cooperating with the bracket structure 36. The cam portion of the slider member 72 includes a wall section 74 which terminates in a sloping cam surface 76. The cam surface 76 bears against the operating end 58 of the adjusting lever 34 to vary the biasing force of the spring 32 within the switch mechanism housing 27. At both ends of the cam surface 76, the wall section 74 is provided with extensions 78 which act as stops by engaging the end 58 of the lever 34 at either end of the cam excursion. The stops 78 accordingly define the normal range of travel of the slider 72.

The slider element 72 is formed with an operator engagable button 80 which extends outwardly from a top section 82 of the slider member 72 and when installed in the washing machine 10, extends outwardly through a slot 84 in the washing machine control panel so that an operator can effect sliding movement of the slider element 72.

To mount the slider element 72 on the bracket structure 36, the slider element 72 is formed with a pair of projections 86 extending outwardly from the wall section 74. Each of the projections 86 is generally T-shaped and includes a stem portion 88 and an enlarged head portion 90. The vertical dimension of the stem portion 88 (as viewed in FIG. 5) is only very slightly smaller than that of the slot 68 in the bracket structure 36, with sufficient clearance to allow the slider member 72 to effect sliding movement with respect to the bracket structure 36. However, the dimension of the head portion 90 is larger than the slot 68 but smaller than the enlarged region 70 so that the projections 86 may be inserted through the enlarged region 70 and then when the slider member 72 is moved so that the projections 86 are in the region of the slot 68, the slider member 72 is held on the bracket structure 36. The relative position of the enlarged region 70 is such that when the slider element 72 is within its normal range of travel, as limited by the stop extension 78, the projections 86 do not fall within the enlarged region 70.

To assemble the described arrangement, the slider member 72 is first mounted on the bracket structure 36, in the manner discussed above. The bracket structure 36 is then secured to the switch mechanism housing 27. The operating end 58 of the lever 34 is then placed in the opening 56 and, with the spring 62 in place, the tail 54 of the lever 34 is put through the opening 52.

Accordingly, there has been disclosed an improved adjustable pressure responsive switch assembly. It is understood that the above-described embodiment is merely illustrative of the application of the principles of this invention. Numerous other embodiments may be devised by those skilled in the art without departing from the spirit and scope of this invention, as defined by the appended claims.

We claim:

1. An adjustable pressure responsive switch assembly comprising:

a pressure actuated switch mechanism;

an adjustable element in said switch mechanism for effectively varying the relative pressure at which said switch mechanism will actuate;

bracket structure supporting said switch mechanism, said bracket structure including a planar piece having an elongated open slot therein;

a unitary slider member including cam means for engaging with and effecting movement of said adjustable element to vary the adjustment of said switch mechanism as said slider member is moved, said slider member being formed with stop means at each end of said cam means for engaging said adjustable element at the extremes of the normal range of travel of said cam means with respect to said adjustable member so as to prevent travel of said slider member beyond the normal range when the assembly is complete; and means mounting said unitary slider member on said bracket structure including means projecting through said slot and attached to said slider member, said projecting means being formed as a unitary part of said slider member and including a stem portion and an enlarged head portion, said slot having an enlarged region through which said head portion is inserted, said enlarged region being outside the normal range of travel of said projecting means along said slot.

2. The assembly according to claim 1 further including an operator engagable button formed as a unitary part of said slider element.

3. The assembly according to claim 1 wherein said bracket structure includes means for supporting said adjustable element.

* * * * *